US007484867B2

(12) United States Patent
Farmer

(10) Patent No.: US 7,484,867 B2
(45) Date of Patent: Feb. 3, 2009

(54) CONFIGURABLE LAMP SET

(75) Inventor: Edmund Farmer, Williston, VT (US)

(73) Assignee: Verilux, Inc., Stamford, CT (US)

( * ) Notice: Subject to any disclaimer, the term of this patent is extended or adjusted under 35 U.S.C. 154(b) by 200 days.

(21) Appl. No.: 11/311,744

(22) Filed: Dec. 19, 2005

(65) Prior Publication Data

US 2007/0019420 A1 Jan. 25, 2007

Related U.S. Application Data

(60) Provisional application No. 60/701,168, filed on Jul. 21, 2005.

(51) Int. Cl.
*F21S 8/08* (2006.01)

(52) U.S. Cl. ..... 362/410; 362/396; 362/413

(58) Field of Classification Search ..... 362/190, 362/191, 198, 285, 287, 288, 396, 410, 413, 362/414, 418, 419, 427
See application file for complete search history.

(56) References Cited

U.S. PATENT DOCUMENTS 258,571 A 5/1882 Garceau
1,456,194 A 5/1923 Rosenberg
4,484,255 A 11/1984 Warshawsky
4,661,895 A 4/1987 Hull
5,158,361 A 10/1992 Huang
5,615,946 A 4/1997 Yeh
5,716,125 A * 2/1998 Aubrey ..... 362/260
6,079,857 A * 6/2000 Mendelsohn et al. ..... 362/427
7,244,052 B2 * 7/2007 Lee ..... 362/413
2004/0212314 A1 10/2004 Nevins
2004/0252515 A1 12/2004 Opolka

* cited by examiner

*Primary Examiner*—Y My Quach Lee
(74) *Attorney, Agent, or Firm*—St. Onge Steward Johnston & Reens LLC

(57) ABSTRACT

A light fixture assembly kit, distributed in a single package, providing for a versatile light fixture assembly that may be freely configured and re-configured as either a desk-mounted light fixture, a floor-mounted light fixture or a clamp-type mounted light fixture. The light fixture assembly kit provided as a premium to a customer for obtaining an article of commerce or a service, such that the various configuration pieces may be provided as upgrades or additional premiums as the customer obtains and/or purchases various articles of commerce or services.

26 Claims, 5 Drawing Sheets

CONFIGURABLE LAMP SET

PRIORITY DOCUMENTS

This application claims the benefit of the filing date of U.S. Provisional Patent Application Ser. No. 60/701,168 filed Jul. 21, 2005.

FIELD OF THE INVENTION

The invention relates to a configurable lamp set, and more specifically to a configurable lamp set that is supplied as a premium to influence consumers to obtain another article of commerce. The configurable lamp set being supplied as a floor standing lamp, a desk standing lamp, or a clamp-type desk lamp, all three configurations being packaged in one kit.

BACKGROUND OF THE INVENTION

The offering of premiums in order to influence potential customers to obtain a product offering has been used for many years. A wide variety of goods and services have been offered as premiums. It is desirable to offer a premium having various levels of upgradeability, so that the business can encourage the customer to purchase. For example, a premium may be offered to a customer if the customer agrees to try the product for a specified period of time. Even if the customer does not agree to purchase the product, the customer is allowed to retain the premium. To further encourage the customer to purchase the product, it may be advantageous to further offer an upgrade to the premium. Various levels of upgrades for the premium are desirable so as to provide the seller with additional leverage to close the sale and/or encourage the customer to purchase still additional products.

However, lamps have typically not been used in this fashion as they are typically unitary in nature and not upgradeable. Different lamps may be used, however, being able to provide additional elements or versatility to a light fixture has typically been very difficult.

Light fixtures, whether floor mounted, desks mounted or having clamp-type assemblies have been known for many years. However, typically if a user wants a floor lamp he/she must specifically obtain a floor lamp, which may only be used in that application. Alternatively, if the user then wants a desk lamp, he/she must obtain a desk lamp in addition to the floor lamp. The same is true with clamp-type designs.

This disadvantageously means that the user cannot use a lamp for more than one application requiring the user to obtain numerous light fixture assemblies. One answer to this problem is retrofit kits enabling a user to modify the original lamp from one configuration to another. However, these typically produce an inferior product and once changed, cannot be subsequently changed back. Another problem with these retrofit kits is that the user has to go out and obtain the kit. In addition, while the original lamp assembly may have a UL listing, the altered lamp assembly is no longer UL listed, meaning that the configuration has not been approved as a safe assembly. This does not provide piece of mind to the user and in some circumstances, such as in public facilities and applications, non-UL listed equipment cannot be used.

Many light fixtures offered for sale include assembly directions and may provide for various assembly options according to the user's preferences. However, while some flexibility may be provided with these fixtures, the option to freely select from among many various lamp configurations is not provided for. Additionally, typically the assembly options are again one-way type options that do not allow for subsequent alteration of the selected assembly.

For example, U.S. Pat. No. 5,158,361 to Huang ("the '361 patent") is directed toward a lamp frame assembly that can be set up as a desk lamp or floor lamp or a wall fixture. However, the '361 patent teaches use of two rigid arm sections that may be bent to adjust the location of the light fixture head. This is disadvantageous because the rigid arm sections require a relatively large amount of space to swing the cantilevered arms, such that, the light fixture cannot be positioned close to, for example, a wall or bookshelf. Additionally, the '361 patent fails to disclose or teach that all of the parts and pieces required for the various configurations are provided in a single packaged offering or that the system is re-configurable after initial configuration. Still further, the '361 patent is not a fluorescent light fixture as there is no ballast provided, as there is no place to locate a ballast on the fixture.

Accordingly what is desired then is a light fixture assembly kit, which may be provided as a premium to a customer, allowing for various upgrades that provide additional versatility or configurations to be provided to the customer as an incentive offering.

It is further desired to provide a light fixture assembly kit, provided as a single packed unit, which allows the user to freely select from among various light fixture assembly configurations.

It is still further desired to provide a light fixture assembly kit, which allows the user to freely re-select from among various lamp assembly configurations, even after the user has originally selected an initial assembly configuration.

It is still further desired to provide a light fixture assembly kit, which provides for at least tree assembly configurations and provided in one package, such that, the user does not have to obtain additional kits or options in order to configure the light fixture assembly as desired.

SUMMARY OF THE INVENTION

These and other objects are achieved in one advantageous embodiment by the provision of a fully configurable light fixture assembly kit, where a base configuration may be provided to a potential customer as a premium and as a further incentive, additional configuration pieces may be provided to the customer as an upgrade premium.

Still further, the above-listed objectives are achieved in an advantageous embodiment by the provision of a light fixture assembly kit that includes at least three basic configurations including: a floor lamp configuration, a desk lamp configuration, and a clamp-type mounting configuration packaged and distributed in a single kit. In this manner the user may at their option, freely select from among the various assembly configurations as desired.

It is further contemplated that the various assembly options are fully re-configurable allowing the user to select an initial assembly configuration, while still allowing for use of the alternative assembly options at a later time.

For example, it is contemplated that a light fixture assembly kit may include, in one advantageous embodiment: a light fixture head piece for holding a lamp, which may further include a flexible stem portion, an extension or shaft piece(s) for attachment to the flexible stem portion, a light fixture base piece for attachment to the extension or shaft piece(s), a clamp-type base piece, and a wiring harness. With these various basic parts, the user may assemble the light fixture as a floor-mounted light fixture including lamp head, extension or shaft piece(s) and a light fixture base piece for the floor lamp assembly configuration. Alternatively, the user may remove one or all of the extension or shaft piece(s) thereby reducing the height of the light fixture assembly such that it may effectively be used in the desk-mounted light fixture. Still further, the user may remove the light fixture base piece from the desk-mounted light fixture configuration and replace it with a clamp-type base piece, which allows the light fixture assembly to be affixed to, for example, a protrusion, such as a desk or shelf in the clamp-type configuration.

It is contemplated that all of the various components required for configuring the light fixture assembly into these various configurations may be packaged and distributed as a single kit. In this manner, the user will not have to purchase three light fixtures for three different applications, but rather can purchase one light fixture assembly provided in one package. In addition, factory instruction will be provided for instructing the individual as to how to convert the light fixture assembly. Because the light fixture assembly is designed for reconfiguration and all the pieces for reconfiguration are supplied by the factory, quality control issues can be addresses and managed resulting in a superior product.

In addition, the reconfigurable light fixture assembly may be completely UL listed for each configuration, meaning that the reconfigured product is safe for use, resulting in piece of mind for the user.

Alternatively, when the reconfigurable light fixture assembly is utilized as a premium item, various configurations may be provided to the customer as incentives to purchase an associated product. Each upgrade may allow the customer a different configuration. Additionally, it is contemplated that the initial or base premium may be selectable by the customer, as well as the particular configuration of the upgrade premium. In this manner additional configurations may be offered as further upgrades to the initial premium.

In this application, the terms "coupled", "coupled to", and "coupled with" as used herein each mean a relationship between or among two or more devices, apparatus, components, networks, systems, subsystems, and/or means, constituting any one or more of (a) a connection, whether direct or through one or more other devices, apparatus, components, networks, systems, subsystems, or means, (b) a functional relationship in which the operation of any one or more devices, apparatus, components, networks, systems, subsystems, or means depends, in whole or in part, on the operation of any one or more others thereof.

In one advantageous embodiment a light fixture assembly kit is provided comprising the following components provided in a single packaged offering, a light fixture head for holding a lamp, the light fixture head further including a flexible stem, and an elongated extension piece connectable to the flexible stem. The light fixture assembly kit further comprises a light fixture base connectable to either the flexible stem or the extension piece, and a light fixture clamp coupling connectable to either the flexible stem or the extension piece. The light fixture assembly kit is provided such that the light fixture assembly is configurable as: a floor light fixture including, the light fixture head, the elongated extension piece and the light fixture base; or a desk light fixture including, the light fixture head and the light fixture base; or an attachable light fixture including, the light fixture head and the light fixture clamp coupling. The light fixture assembly kit is further provided such that the light fixture assembly is freely re-configurable in any of the floor, desk and attachable light fixture configurations.

In another advantageous embodiment a method for providing a light fixture assembly kit as a premium for obtaining an article of commerce or a service is provided, comprising the following steps, providing a first light fixture assembly kit when a customer agrees to accept a first product offering. The premium is provided such that the first light fixture assembly kit includes at least one light fixture assembly configuration selected from the group consisting of: a floor light fixture configuration including, a light fixture head, an elongated extension piece and a light fixture base; or a desk light fixture configuration including, the light fixture head and the light fixture base; or an attachable light fixture configuration including, the light fixture head and a light fixture clamp coupling. The method further comprises the step of providing a second light fixture assembly kit when a customer agrees to accept a second product offering. The second light fixture assembly kit includes the parts corresponding to the remaining configurations such that the customer may then assemble the light fixture assembly into any of the floor light fixture configuration, the desk light fixture configuration or the attachable light fixture configuration.

In still another advantageous embodiment a fluorescent light fixture assembly kit is provided comprising the following components provided in a single packaged offering, a light fixture head for holding a fluorescent lamp, the light fixture head further including a flexible stem having a first end coupled to the light fixture head and a second end coupled to a housing, which contains a ballast, and a wiring harness extending from the light fixture head through the flexible stem to the ballast and an electrical cord coupled to the ballast for supplying electrical power to the ballast. The light fixture assembly kit further comprises, an elongated extension piece connectable to the housing, a light fixture base connectable to either the housing or the extension piece, and a light fixture clamp coupling connectable to either the housing or the extension piece. The light fixture assembly is configurable as: a floor light fixture including, the light fixture head, the elongated extension piece and the light fixture base; or a desk light fixture including, the light fixture head and the light fixture base; or an attachable light fixture including, the light fixture head and the light fixture clamp coupling. In addition, the light fixture assembly is freely re-configurable in any of the floor, desk and attachable light fixture configurations.

Other objects of the invention and its particular features and advantages will become more apparent from consideration of the following drawings and accompanying detailed description.

DETAILED DESCRIPTION OF THE DRAWINGS

Figure 1:
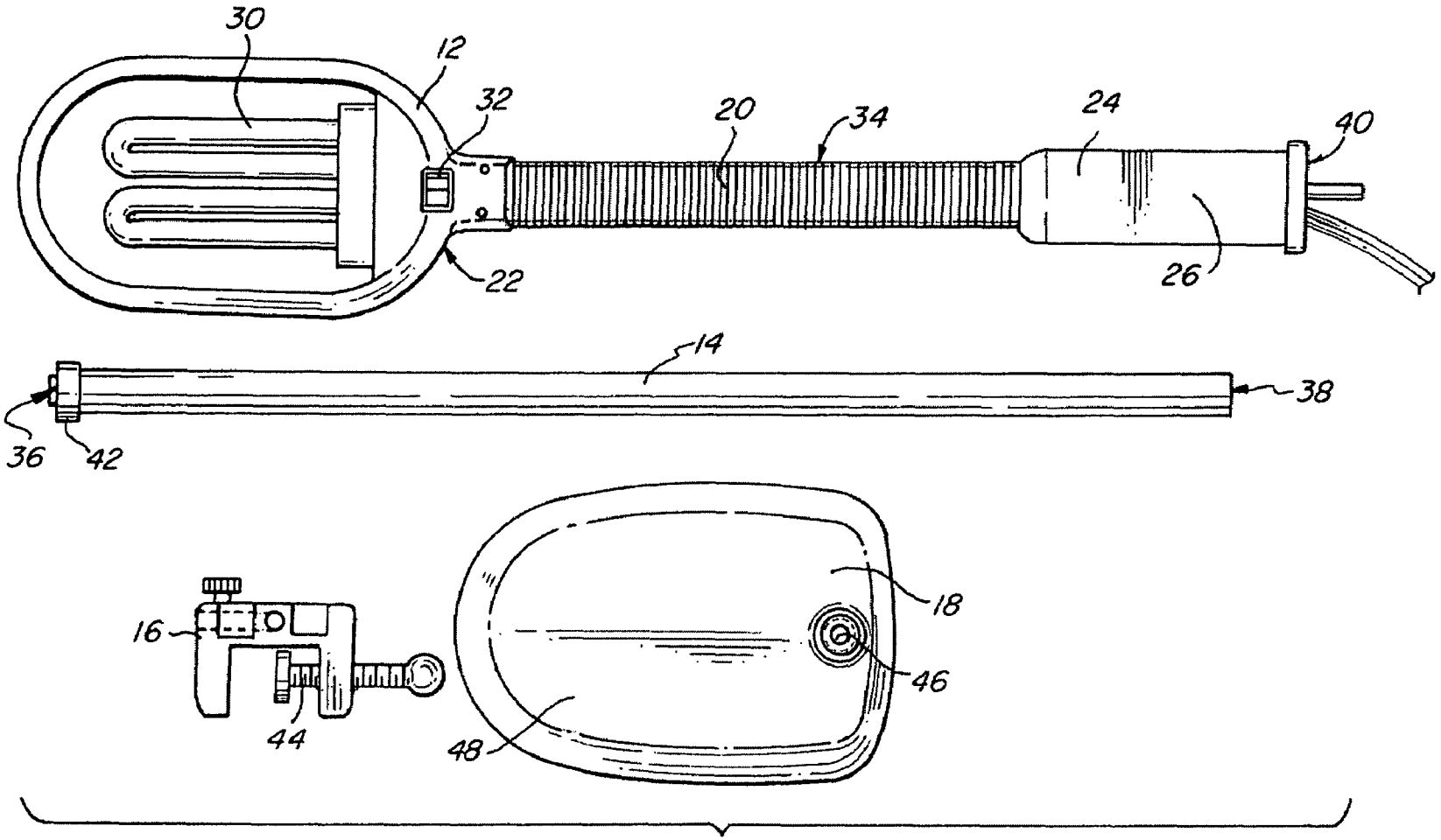
FIG. 1 is a top view illustrating the various components included in the light fixture assembly kit.

Referring now to the drawings, wherein like reference numerals designate corresponding structure throughout the views.

FIG. 1 illustrates the various parts that are included in light fixture assembly kit 10. These include: lamp head 12, extension piece 14, clamp coupling 16 and the base member 18. Lamp assembly kit 10 may be advantageously packaged and sold in one single light fixture package assuring quality of the product, convenience for the user, and full re-configurability for light fixture assembly kit 10.

Lamp head 12 is illustrated as comprising a flexible stem 20 coupled to a proximal end 22 of lamp head 12. Flexible stem 20 is further shown coupled to a housing 24, which contains ballast 26. Housing 24 is further shown with a proximal end 40. A wiring harness (not shown) extends from ballast 26, through flexible stem 20 to lamp head 12, for providing conditioned electrical power for lamp 30. In one advantageous embodiment, lamp 30 may comprise a fluorescent lamp.

Also illustrated in FIG. 1, is switch 32, which is provided to interrupt electrical power to lamp 30.

It is contemplated that flexible stem 20 may include a protective covering or sheath 34, for enclosing the flexible member and wiring harness.

Extension piece 14 is illustrated as a generally elongated shaft having a first end 36 and a second end 38. First end 36 is provided with a raised section 42, which extends circumferentially around extension piece 14. It is contemplated that extension piece 14 may comprise any suitable material, such as, for example, a hard plastic or a metal with a painted or anodized surface.

Clamp coupling 16 is illustrated as a C-clamp configuration, but it contemplated that many differing clamping configurations are possible. A threaded member 44 engages with a portion of the clamp to secure the coupling 16 to a surface. Clamp coupling 16 maybe provided as the same or similar material as extension piece 14.

Base member 18 is illustrated being of a generally flat or low profile construction and may include a weighted portion therein so as to provide stability to the light fixture when so used. A cavity 46 is provided in a top surface 48 of base member 18 and will be discussed further in connection with FIG. 8.

Figure 2:
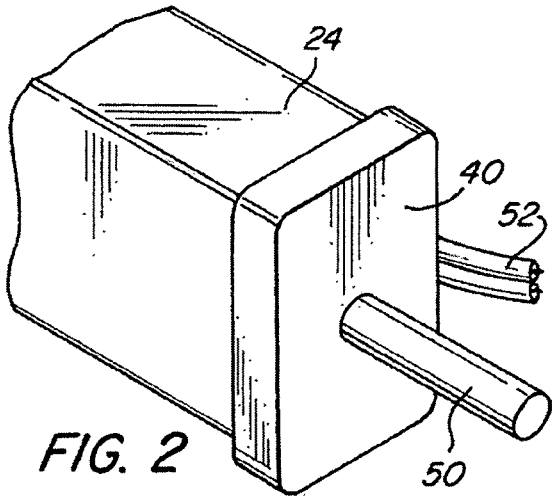
FIG. 2 is a perspective view according to FIG. 1, of one end of the ballast housing.

Turning now to FIG. 2, housing 24 is illustrated in greater detail showing proximal end 40. Extending from proximal end 40 is protrusion 50, which may comprise, for example, a cylindrical metal pin. Also extending from housing 24 is electrical cord 52, which may comprise any standard UL listed cable or cord for providing electrical power to ballast 26 inside of housing 24.

Figure 3:
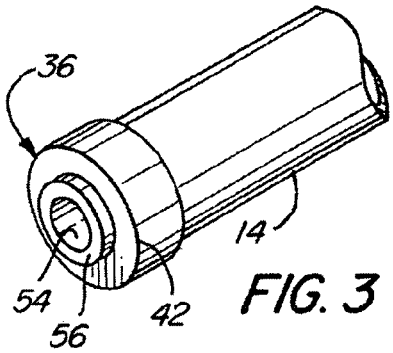
FIG. 3 is a perspective view according to FIG. 1, of one end of the extension piece to be connected to the housing.

Referring to FIG. 3, first end 36 of extension piece 14 is shown in greater detail. A cavity 54 is positioned in first end 36. Cavity 54 is sized to receive protrusion 50 therein. A raised collar 56 is provided encircling cavity 54, for engaging with proximal end 40 of housing 24.

Figure 4:
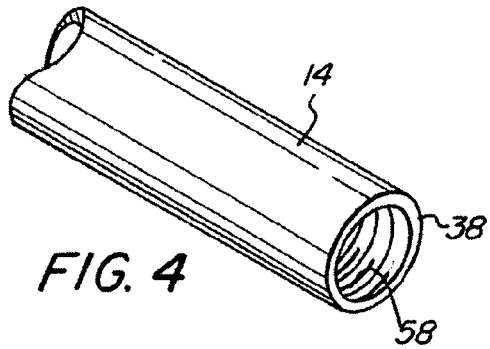
FIG. 4 is a perspective view according to FIG. 1, of one end of the extension piece to be connected to the base.
Figure 5:
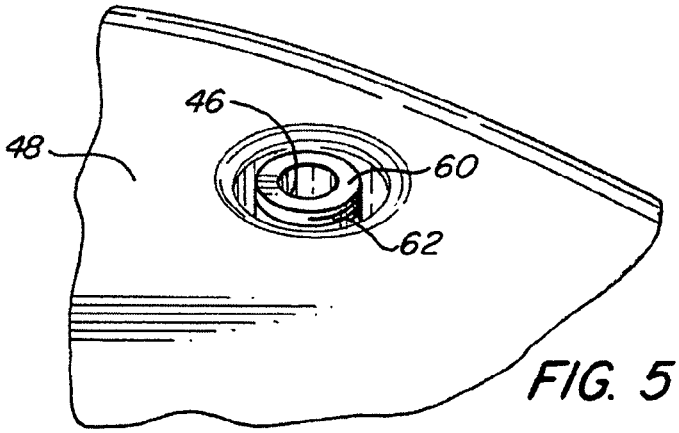
FIG. 5 is a perspective view according to FIG. 1, of the base.

Turing now to FIGS. 4 and 5, illustrated is second end 38 of extension piece 14. An interior of extension piece 14 is provided as a threading 58. As seen in FIG. 5, cavity 46 is surrounded by coupling piece 60, which is provided with threading 62 on an exterior portion thereof. In this way, threading 58 may be fitted over coupling piece 60 and threadingly engaged with threading 62 to affix extension piece 14 to base member 18.

Figure 6:
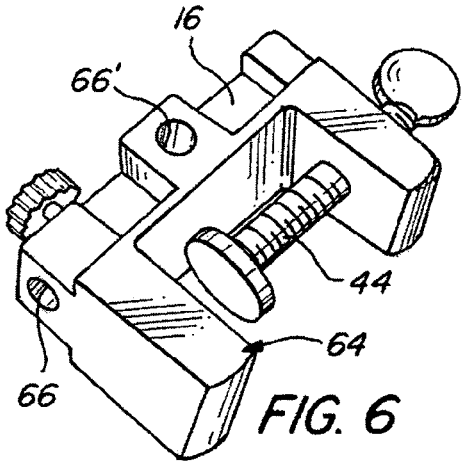
FIG. 6 is a perspective view according to FIG. 1, of the clamp device.

FIG. 6 illustrates clamp coupling 16 as a C-clamp configuration including a threaded member 44 that engages with a clamping surface 64 for securing the clamp coupling 16 to a structure. Also provided is a cavity 66, 66', which is provided to receive protrusion 50. Cavities 66, 66' are provided at right angles to each other to allow for various mounting angles for the clamp coupling 16.

Figure 7:
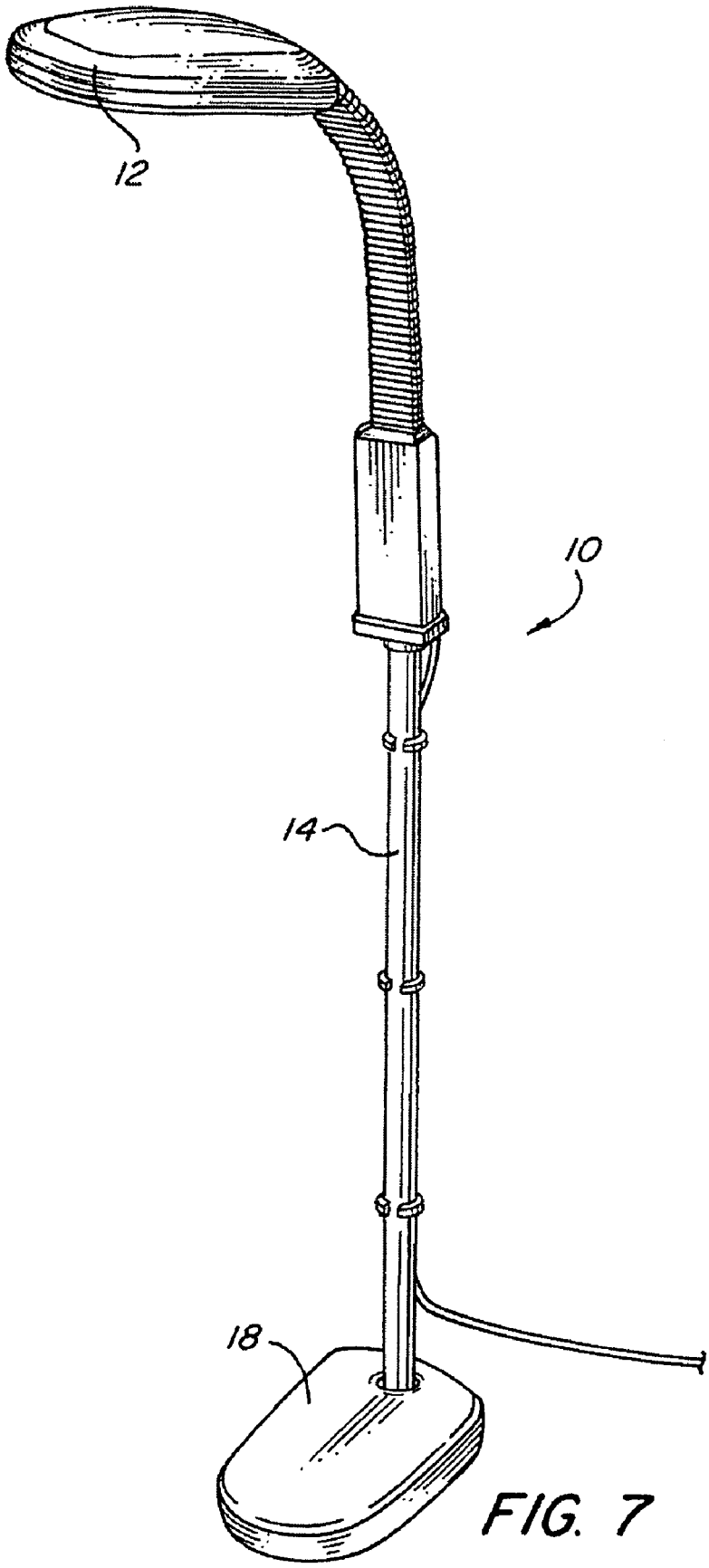
FIG. 7 is a front perspective view according to FIG. 1, of the light fixture assembly kit illustrating the floor mounted configuration.
Figure 8:
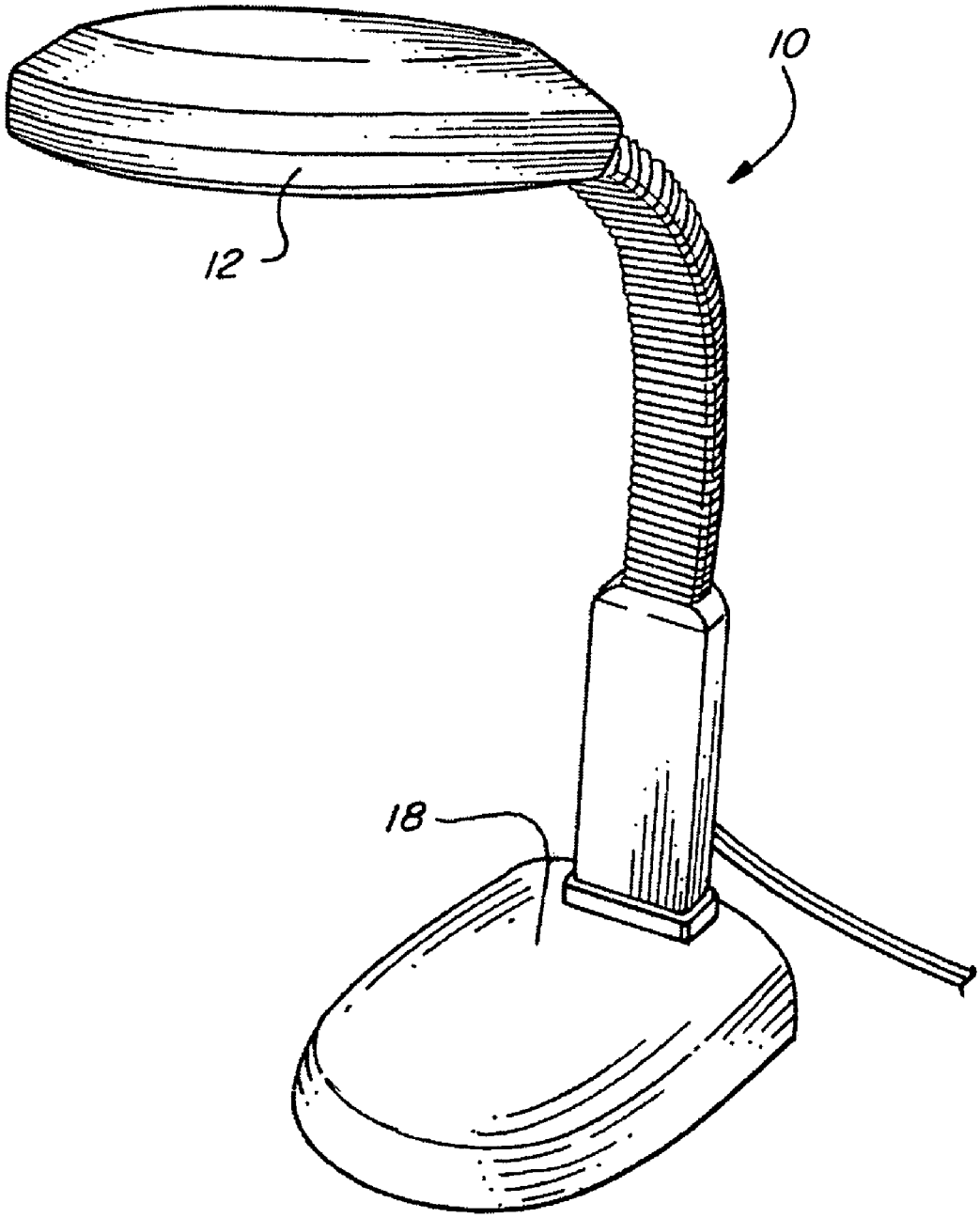
FIG. 8 is a front perspective view according to FIG. 1, of the light fixture assembly kit illustrating the desk mounted configuration.
Figure 9:
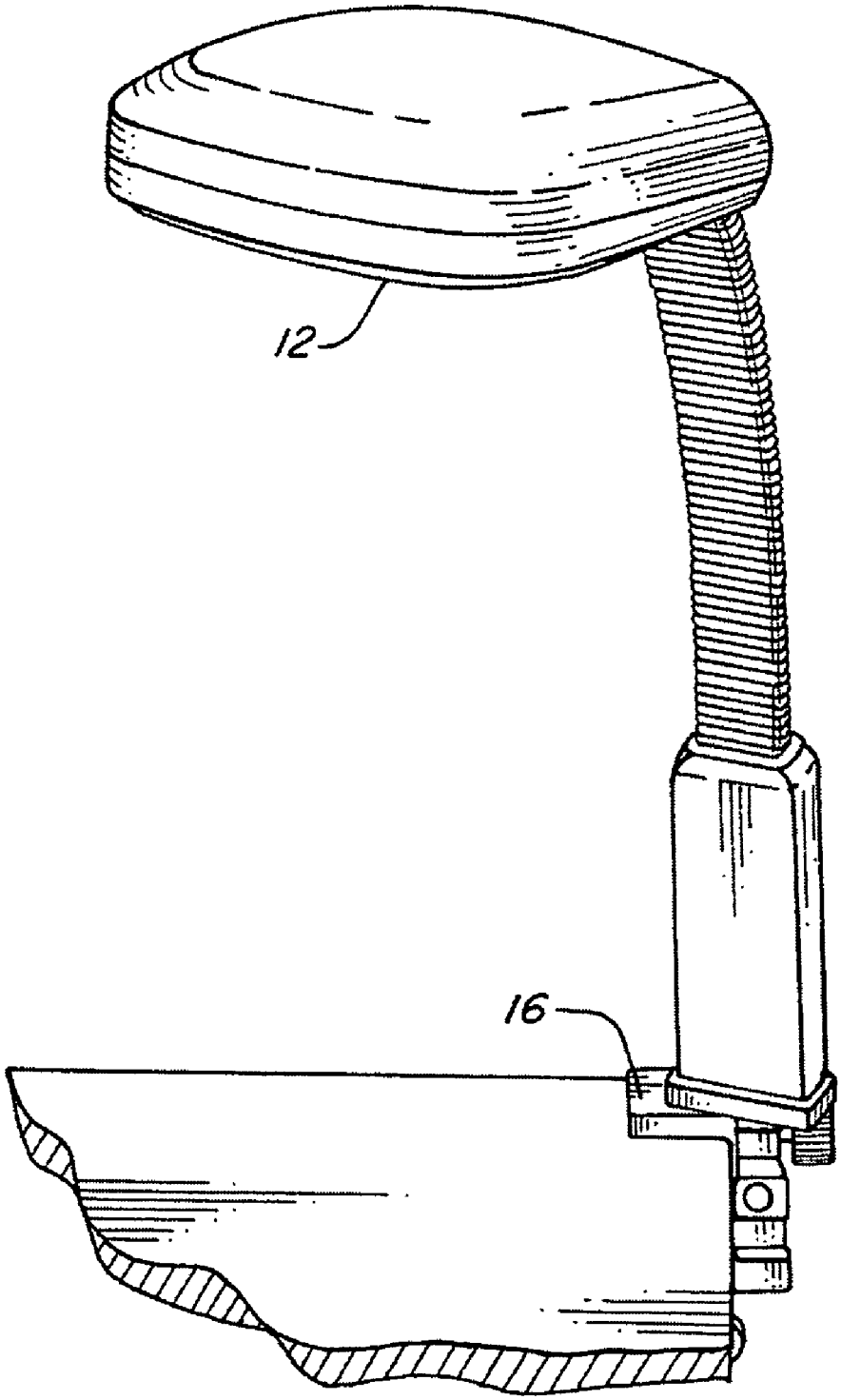
FIG. 9 is a front perspective view according to FIG. 1, of the light fixture assembly kit illustrating the clamp-type configuration.

Referring now to FIGS. 7-9, various configurations of light fixture assembly kit 10 are illustrated.

For example, FIG. 7 illustrates light fixture assembly kit 10 assembled as a floor-mounted light fixture configuration. As a floor-mounted configuration, lamp head 12 is provided and connected to extension piece 14, which is in turn connected to base member 18. In this configuration, protrusion 50 is inserted into cavity 54 in extension piece 14. Extension piece is in turn threaded onto coupling piece 60 of base member 18.

FIG. 8 discloses yet another embodiment of the present invention showing a desk-mounted light fixture configuration. As a desk-mounted configuration, lamp head 12 is provided directly connected to base member 18. In this configuration, protrusion 50 is inserted into cavity 46 in base member 18.

FIG. 9 discloses still another embodiment of the present invention showing a clamp-type mounting configuration. In this configuration, lamp head 12 is directly connected to clamp coupling 16, which may further be affixed to an edge of, for example, a desk or a shelf. In this configuration, protrusion 50 is inserted into cavity 66, 66' in clamp coupling 16, depending upon the desired orientation.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A light fixture assembly kit comprising the following components provided in a single packaged offering:

a light fixture head for holding a lamp;

said light fixture head further including a stem;

an elongated extension piece connectable to the stem;

a light fixture base connectable to either the stem or said extension piece;

a light fixture clamp coupling connectable to the stem;

said light fixture assembly is configurable as:

a floor light fixture including, said light fixture head, said elongated extension piece and said light fixture base;

a desk light fixture including, said light fixture head and said light fixture base; and an attachable light fixture including, said light fixture head and said light fixture clamp coupling;

said light fixture assembly kit being freely re-configurable in any of the floor, desk and attachable light fixture configurations.

2. The light fixture assembly kit according to claim 1 further comprising a wiring harness extending from said light fixture head for providing electrical power to the lamp.

3. The light fixture assembly kit according to claim 1 further comprising a ballast.

4. The light fixture assembly kit according to claim 3 wherein said ballast is enclosed by a housing.

5. The light fixture assembly kit according to claim 4 wherein said housing comprises a protrusion extending from an axial end of the housing opposite the end coupled to the flexible stem.

6. The light fixture assembly kit according to claim 5 wherein said extension piece comprises a cavity sized to receive said protrusion.

7. The light fixture assembly kit according to claim 6 wherein a raised collar is provided around the cavity in said extension piece.

8. The light fixture assembly kit according to claim 6 wherein the cavity is positioned at one end of said extension piece for receiving the protrusion positioned on the housing, and a threading is positioned at the other end of said extension piece to engaging with a corresponding threading located on said light fixture base.

9. The light fixture assembly kit according to claim 5 further comprising a coupling piece located in said base member for coupling to either said ex-tension piece or said stem.

10. The light fixture assembly kit according to claim 9 wherein said coupling piece comprises a cavity sized to receive said protrusion.

11. The light fixture assembly kit according to claim 9 wherein said coupling piece comprises a threading to engage with a corresponding threading located on said extension piece.

12. The light fixture assembly kit according to claim 5 wherein said light fixture clamp coupling comprises a cavity sized to receive said protrusion.

13. The light fixture assembly kit according to claim 5 wherein said light fixture clamp coupling comprises at least two cavities positioned on different angular surfaces of said light fixture clamp coupling to receive said protrusion.

14. The light fixture assembly kit according to claim 1 wherein said light fixture clamp coupling comprises a C-clamp with a threaded clamping member.

15. The light fixture assembly kit according to claim 1 wherein said lamp comprises a fluorescent lamp.

16. The light fixture assembly kit according to claim 1 wherein said light fixture head further comprises a switch located thereon for interrupting the supply of electrical power to the lamp.

17. The light fixture assembly kit according to claim 1 wherein said light fixture head is adjustable to a plurality of locations.

18. The light fixture assembly kit according to claim 1 wherein said stem comprises a flexible stem.

19. A fluorescent light fixture assembly kit comprising the following components provided in a single packaged offering:

a light fixture head for holding a fluorescent lamp;

said light fixture head further including a stem having a first end coupled to said light fixture head and a second end coupled to a housing, which contains a ballast;

a wiring harness extending from said light fixture head through the stem to the ballast and an electrical cord coupled to said ballast for supplying electrical power to said ballast;

an elongated extension piece connectable to the housing;

a light fixture base connectable to either the housing or said extension piece;

a light fixture clamp coupling connectable to the housing;

said light fixture assembly kit is configurable as:

a floor light fixture including, said light fixture head, said elongated extension piece and said light fixture base;

a desk light fixture including, said light fixture head and said light base; and an attachable light fixture including, said light fixture head and said light fixture clamp coupling;

said light fixture assembly kit being freely re-configured in any of the floor, desk and attachable light fixture configurations.

20. A light fixture assembly kit comprising the following components provided in a single packaged offering:

a head including a lamp and a stem;

an extension piece connectable to the stem;

a base connectable to either the stem or the extension piece;

a clamp coupling connectable to the stem;

said light fixture assembly kit is configurable as:

a floor light fixture including, said head, said extension piece and said base;

a desk light fixture including, said head and said base; and an attachable light fixture including, said head and said clamp coupling;

said light fixture assembly kit being freely re-configured in any of the floor, desk and attachable light fixture configurations.

21. The light fixture assembly kit according to claim 20 further comprising a wiring harness extending from said head for providing electrical power to the lamp.

22. The light fixture assembly kit according to claim 20 further comprising a ballast.

23. The light fixture assembly kit according to claim 20 wherein said lamp comprises a fluorescent lamp.

24. The light fixture assembly kit according to claim 20 wherein said light fixture clamp coupling comprises a C-clamp with a threaded clamping member.

25. The light fixture assembly kit according to claim 20 wherein said light fixture head is adjustable to a plurality of locations.

26. The light fixture assembly kit according to claim 20 wherein said stem comprises a flexible stem.

* * * * *